US008294086B2

(12) United States Patent
Holle

(10) Patent No.: US 8,294,086 B2
(45) Date of Patent: Oct. 23, 2012

(54) MULTIPLEXING DAUGHTER ION SPECTRUM ACQUISITION FROM MALDI IONIZATION

(75) Inventor: Armin Holle, Achim (DE)

(73) Assignee: Bruker Daltonik GmbH, Bremen (DE)

( * ) Notice: Subject to any disclaimer, the term of this patent is extended or adjusted under 35 U.S.C. 154(b) by 396 days.

(21) Appl. No.: 12/253,576

(22) Filed: Oct. 17, 2008

(65) Prior Publication Data

US 2009/0101813 A1 Apr. 23, 2009

(30) Foreign Application Priority Data

Oct. 17, 2007 (DE) ..... 10 2007 049 640

(51) Int. Cl.
*H01J 49/40* (2006.01)

(52) U.S. Cl. ..... 250/282; 250/281; 250/286; 250/287; 250/294; 250/295

(58) Field of Classification Search ..... 250/281, 250/282, 283, 286, 287, 294, 295, 298, 299, 250/300
See application file for complete search history.

(56) References Cited

U.S. PATENT DOCUMENTS 5,734,161 A * 3/1998 Koster ..... 250/287
5,898,173 A * 4/1999 Franzen ..... 250/287
6,300,627 B1 * 10/2001 Koster et al. ..... 250/287
6,489,610 B1 * 12/2002 Barofsky et al. ..... 250/287
6,534,764 B1 * 3/2003 Verentchikov et al. ..... 250/287
6,703,608 B2 * 3/2004 Holle et al. ..... 250/287
6,717,131 B2 * 4/2004 Holle et al. ..... 250/282
6,723,983 B2 * 4/2004 Holle ..... 250/287
6,861,645 B2 3/2005 Franzen
6,933,497 B2 * 8/2005 Vestal ..... 250/287
7,084,395 B2 8/2006 Fuhrer et al.
7,196,324 B2 3/2007 Verentchikov
7,265,346 B2 * 9/2007 Whitehouse et al. ..... 250/287
7,385,187 B2 * 6/2008 Verentchikov et al. ..... 250/287
7,838,824 B2 * 11/2010 Vestal ..... 250/287
2002/0145110 A1 * 10/2002 Holle ..... 250/287
2005/0165560 A1 * 7/2005 Kushnir et al. ..... 702/30
2006/0108521 A1 * 5/2006 Holle et al. ..... 250/287
2010/0065737 A1 * 3/2010 Bateman et al. ..... 250/283

* cited by examiner

*Primary Examiner* — Michael Logie
(74) *Attorney, Agent, or Firm* — O'Shea Getz P.C.

(57) ABSTRACT

The invention relates to the measurement of daughter ion spectra of analyte substances that are ionized by means of matrix-assisted laser desorption. The invention shows how to record several daughter ion spectra from several parent ions per single pulse of laser light, that is per desorption event, by spatially splitting the ion beams or by temporally sequencing the spectral measurement; the various parent ions are selected one after another by switching the parent ion selector several times. Summing up corresponding individual daughter ion spectra from many pulses of laser light leads to several sum spectra being recorded practically synchronously with the same series of laser light pulses, with correspondingly reduced sample consumption and shortened data acquisition time.

14 Claims, 2 Drawing Sheets

MULTIPLEXING DAUGHTER ION SPECTRUM ACQUISITION FROM MALDI IONIZATION

PRIORITY INFORMATION

This patent application claims priority from German patent application 10 2007 049 640.2 filed Oct. 17, 2007, which is hereby incorporated by reference.

FIELD OF THE INVENTION

The invention relates to the measurement of daughter ion spectra of analyte substances that are ionized by matrix-assisted laser desorption.

BACKGROUND OF THE INVENTION

For the ionization of analyte ions by matrix-assisted laser desorption, the samples consisting of matrix substance with small numbers of embedded analyte molecules, are bombarded with short pulses of light from a UV laser. Each pulse of laser light generates a plasma cloud of desorbed sample material. When the pulses of laser light are of moderate power, practically only molecular ions are created from the analyte molecules in the plasma cloud, not fragment ions, and therefore several types of analyte substance can be present in the sample and recognized simultaneously by their mass—in other words, mixture analyses can be carried out.

The method of ionization by matrix-assisted laser desorption is, in general, used to investigate large biomolecules, particularly large biopolymers such as, primarily, proteins or peptides obtained from proteins by enzymatic digestion, which yield mass spectra that can be evaluated effectively above 1000 Daltons. It is also possible to investigate their conjugates with sugars (glycopeptides) or fats (lipopeptides) in this way. (The spectrum in the range below 1000 Dalton usually is covered by very strong background noise and cannot be evaluated).

The only information contained in the mass spectra of the molecular ions is the molecular weight of the analyte molecules; there is no information about their identity or internal structure. Although it is possible to identify the proteins from the molecular weights of their digestion peptides by comparison with virtually digested proteins in a protein database, this identification does not offer a high degree of certainty. Modifications of the proteins can only be very approximately found by this method. Protein sequences, and also the structures of the conjugates, can only be recognized by recording the mass spectra of daughter ions obtained by fragmentation of the analyte ions in question.

In MALDI time-of-flight mass spectrometers, two different kinds of fragmentation processes can be carried out in order to generate daughter ions and, particularly in the case of proteins and peptides, they lead to different fragmentation patterns. The two types of fragmentation are referred to as ISD ("in-source decay") and PSD ("post-source decomposition"). ISD requires the analysis of pure substances in relative high amounts, it is applied rarely up to now. Therefore, the acquisition of daughter ions generated by PSD is the predominant method.

To acquire daughter ion spectra created by PSD, the intensity of the laser light (energy density or fluence) is increased. As a result, a large number of unstable analyte ions are generated which, after their acceleration in the ion source, decompose with characteristic half-lives during their flight through the mass spectrometer, so forming daughter ions (also known as fragment ions). The unstable ions that decompose in the flight path of the mass spectrometer are often referred to as "metastable" ions. Recording the PSD daughter ion spectra, which in the past was a very complicated process that was only done piece by piece throughout the full mass spectrum, is nowadays carried out in one go in time-of-flight mass spectrometers specially designed for this purpose. Such a mass spectrometer is described in U.S. Pat. No. 6,300,627 B1.

FIG. 1 schematically illustrates a MALDI time-of-flight mass spectrometer for acquiring daughter ion spectra. A pulsed UV laser 3 sends a pulse of laser light through a focusing lens 4 and a deflecting mirror 5 onto the sample 6, which is located on a sample support 1 in a dried state. A small amount of the sample material abruptly evaporates, forming a plasma cloud. The ions in the plasma cloud include a great excess of matrix complex ions of every mass up to around 1000 Daltons, generating in the mass spectrum a huge background noise. The embedded analyte ions can therefore be measured effectively only in the higher mass range from about 1000 Daltons to 5000 Daltons. Accelerating potentials at the acceleration diaphragms 7 and 8 form the ions into an ion beam 9. The application of moderate accelerating voltages give a relatively low kinetic energy of only, for instance, 6 keV to the ions. The ions, therefore, are relatively slow and need some time up to the parent ion selector 10. An accelerating voltage that is switched on with a delay relative to the flash of laser light provides time-focusing of ions of the same mass at the location of the parent ion selector 10. This parent ion selector 10 is a bipolar switchable grid that only allows ions through in a straight line during an adjustable switching time window, so making them available for further analytical investigation. The parent ion selector is thus used to select the parent ions whose daughter ions are to be measured. If metastable parent ions have already decomposed between the acceleration diaphragm 8 and the parent ion selector 10, the daughter ions created here can also pass through the parent ion selector, because they have the same velocity as the undecomposed parent ions, and therefore arrive at the parent ion selector at the same time as they do.

The undecomposed parent ions and the daughter ions that have been created through the decomposition of parent ions now fly on to a post-acceleration unit 12, where they are given an additional acceleration by about 20 kilovolts. Prior to the post-acceleration, the daughter ions only possess a fraction of the energy of the parent ions, corresponding to their mass fraction relative to the parent ion. The post-acceleration now gives all the ions additional energy, causing their total kinetic energy to rise to between 20 and 26 kiloelectronvolts, which is particularly favorable for their further flight through the time-of-flight mass spectrometer for mass analysis. The mass analysis, in turn, is carried out by analyzing the time of flight at the detector 17, since the lighter ions, even if somewhat lower in energy, are faster and also reach the detector more quickly along the shorter beam 15 than the more energetic, but slower, ions traveling along the beam 16 that enters more deeply into the reflector 14.

There are different ways of achieving the post-acceleration. As a first approach, the selected ions can be made to fly through a small housing 12, whose potential is raised by about 20 kV while the ions pass through it, so that they are given their acceleration as they leave this housing. As a second approach, however, the entire flight path up to the post-acceleration point can be held at a high base potential of 20 kV. The initial acceleration of 6 kV must therefore be raised above this base potential. In this case, the high post-acceleration voltage of 20 kilovolt does not need to be switched. On the other hand, the initial flight path, including the parent ion selector and a collision cell (if present), must be held continuously at a high potential. This is achieved by locating the flight path of the ions in a long housing that is sealed on all sides, for instance in a tube 20 that is at this potential. The potential of this long tube is kept constant over time, and is not switched.

Daughter ions generated by decompositions of the already post-accelerated parent ions disturb the daughter ion spectrum and must be prevented from being recorded. To prevent these daughter ions from reaching the reflector 14, a further ion selector 13 is included in the ion path between the post-acceleration unit 12 or tube 20 and the reflector 14. This further ion selector 13, called "parent ion suppressor" suppresses the parent ions and their equally fast late daughter ions, as is described in U.S. Pat. No. 6,717,131. This parent ion suppressor 13 is not only necessary to suppress the daughter ions already created after the post-acceleration, but also to suppress the continuous background that would be generated by the daughter ions from parent ions that decompose at a random potential in the reflector 14.

Increasing the laser fluence is only one way to create daughter ions. Alternatively, the daughter ions can be generated by impacts with gas molecules in a collision chamber positioned somewhere between the first acceleration of the ions by the diaphragm 8 and the post-acceleration unit 12. The collision chamber is filled with collision gas at a suitable pressure, and generates fragment ions through the absorption of energy by a number of collisions (CID=collisionally induced decomposition).

In both types of these PSD-MALDI mass spectrometers for recording daughter ion spectra according FIGS. 1 and 2 it is therefore necessary to select the parent ions whose daughter ion spectra are to be acquired. Only relatively few daughter ions are created by each pulse of laser light, so that usually a suitably large number of individual daughter ion spectra is acquired with a few hundred up to a few thousand pulses of laser light, and to sum up these spectra, after the ion signals have been amplified and digitized, to form a sum spectrum of the daughter ions. The daughter ion sum spectrum then covers a sufficiently wide range of intensities to measure different species of ion with large differences in concentration.

When the term "daughter ion spectra" is used below, it follows that an individual daughter ion spectrum is meant when a procedure is being described that results from a single pulse of laser light, and that a daughter ion sum spectrum is meant when referring to the acquisition of spectra in general, for which necessarily a large number of laser light pulses are used.

In the analysis of mixtures, such as the analysis of the 20 to 30 digestion peptides resulting from a large, enzymatically digested protein, it is often desirable to record a daughter ion spectrum for each analyte substance, which in this case means for each digestion peptide. If something like 1000 pulses of laser light are required for each daughter ion spectrum, this means that the sample must be sufficiently large to generate between 20,000 and 30,000 desorption plasma clouds, each created by a strong pulse of laser light. This is often not the case when sample quantities are small.

In addition, the acquisition of such a large number of daughter ion spectra requires a great deal of time. A measurement time of several days is often required to analyze entire proteomes with reliable identification of all the proteins and their post-translational modifications by means of daughter ion spectra.

The term "mass" here always refers to the "charge-related mass" or "mass-to-charge ratio" m/z, which alone is relevant for mass spectrometry, and not simply the "physical mass", m. The dimensionless number z represents the number of elementary charges, that is the number of excess electrons or protons on the ion that have an external effect as an ionic charge. Without exception, all mass spectrometers can only measure the mass-to-charge ratio m/z, not the physical mass m itself. The mass-to-charge ratio is the mass fraction per elementary charge on the ion. Correspondingly, "light" or "heavy" ions always refer to ions with a low or high mass-to-charge ratio m/z. The term "mass spectrum" again always refers to the mass-to-charge ratios m/z.

SUMMARY OF THE INVENTION

According to an aspect of the invention, a mass spectrometer selects a multitude of parent ions in sequence from the ion beam of each single pulse of laser light, and acquires the individual daughter ion spectra of these different parent ions, either spatially separated by directing the ion beams onto different spatially separated ion detectors, or sequentially by sequencing the measurements in time. Corresponding individual daughter ion spectra from each pulse of laser light are added together over a number of laser pulses to form a multitude of daughter ion sum spectra, one each for each parent ion selected. In this way, several daughter ion sum spectra are, in effect, acquired synchronously, instead of acquiring all the daughter ion sum spectra one after another, as in the past.

Using deflection capacitors immediately after the post-acceleration unit, the ion beams from each of the selected daughter and parent ions may be diverted through the reflectors and directed onto several (e.g., two, four, or nine) spatially separated ion detectors located side-by-side in the same plane. Particularly in gridless reflectors with spatially focusing input areas, the individual ion beams may be tightly focused into quite small regions, meaning that such a spatial distribution of the detectors is both effective and possible. The individual ion detectors may also be spatially separated segments of a single ion detector, each of which may measure separate ion currents.

On the other hand, the recording times for individual daughter ion spectra are relatively short, and they are, of course, shorter for individual daughter ion spectra of small molecules than those of large molecules, since the spectrum may be recorded up to the mass of the parent ions (or somewhat less). In addition, the flight times of the daughter ions are rather compressed, as the daughter ions of low mass also possess a lower kinetic energy. On the other hand, the parent ions that have been accelerated by a relatively low potential difference fly relatively slowly before reaching the parent ion selector. In particular, if the path up to the post-acceleration unit is long, and the path from there to the detector is relatively short, several individual daughter ion spectra may be recorded one after another without overlapping. If the analyte ions extend over a relatively large range of masses, then with a favorably low initial acceleration voltage and appropriate lengths for the flight paths, three to six individual daughter ion spectra, for example, may be recorded from a single desorption event one after another without overlapping, and some more daughter ion spectra, if some overlapping is accepted.

If both spatial and temporal separation is carried out simultaneously, then for example 10 to 20 individual daughter ion spectra may be recorded from the same plasma cloud of a laser light pulse. By summing the spectra from about 1000 pulses of laser light, 10 to 20 daughter ion spectra are recorded quasi-synchronously. The amount of sample material used, and the time required to record the daughter ion spectra are reduced by these same factors.

These and other objects, features and advantages of the present invention will become more apparent in light of the following detailed description of preferred embodiments thereof, as illustrated in the accompanying drawings.

Figure 4:
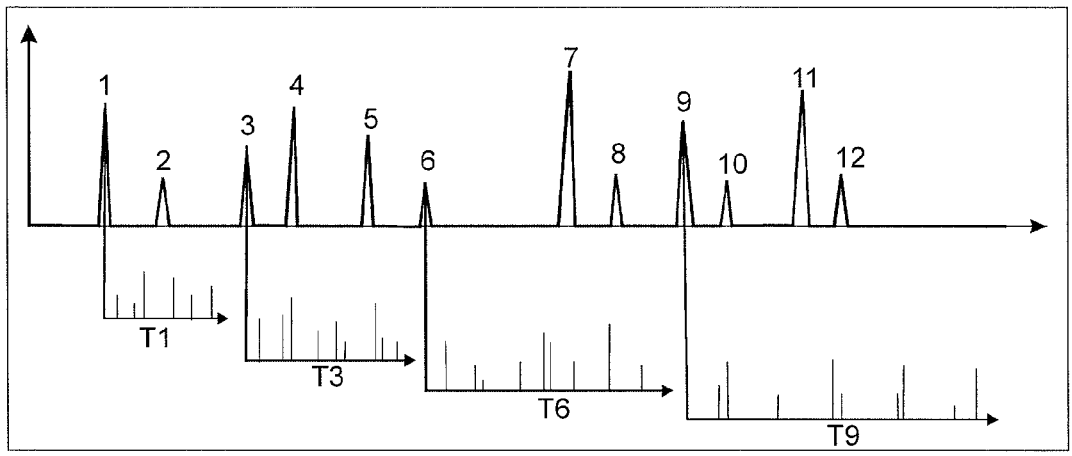

The upper part of FIG. 4 schematically illustrates the ion signals of the molecular ions from a mixture of analyte substances 1-12 as a function of time, as they arrive at the parent ion selector. If the parent ion species 1, 3, 6 and 9 are allowed to pass by the parent ion selector, their individual daughter ion spectra T1, T3, T6 and T9 may be recorded at the ion detector without the need for any further measures and without spectral overlap. These are shown schematically in the lower part of the illustration (also as a function of time).

Figure 5:
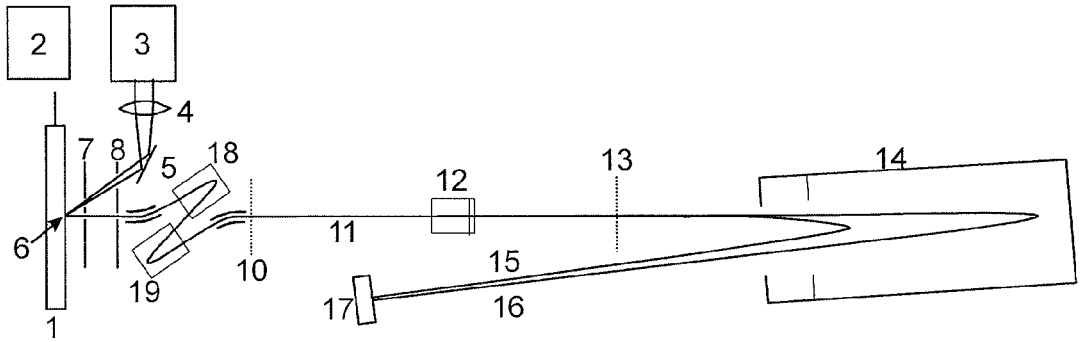

FIG. 5 illustrates an arrangement with two reflectors 18 and 19 and, additionally, deflection capacitors. This arrangement lengthens the path to the parent ion selector 10 in order to obtain more time for recording the daughter ion spectra. It also improves the mass resolution of the parent ion selector 10, and ghost spectra are removed from the daughter ion spectra.

DETAILED DESCRIPTION

Figure 1:
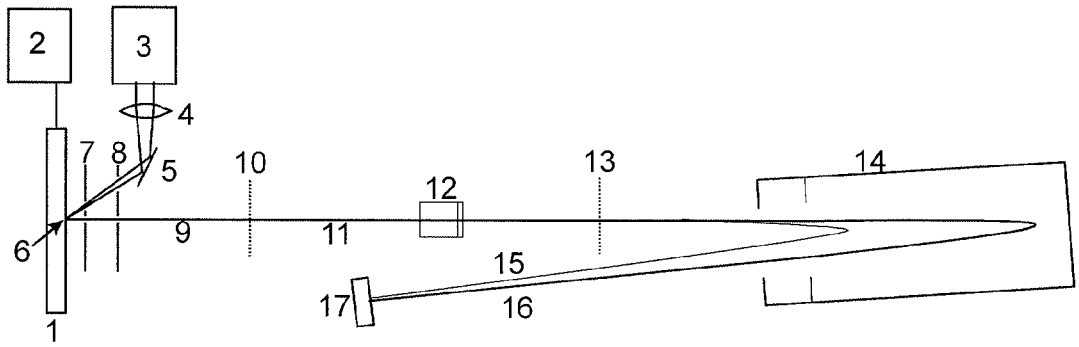
Figure 1 (prior art)
FIG. 1 is a system block diagram illustration of a prior art MALDI time-of-flight mass spectrometer for recording daughter ion spectra. On a sample support plate 1 there are dried portions of samples, which can be mechanically moved, one after another, by a positioning unit 2 into the focus of a UV laser 3. The pulsed UV laser 3 sends a pulse of laser light through a focusing lens 4 and a deflecting mirror 5 onto a sample 6. The ions that are formed in the desorption plasma are shaped into an ion beam 9 by potentials at the acceleration diaphragms 7 and 8. The parent ion selector 10 allows only the selected analyte ions, known as "parent ions", to pass, along with those decomposition products of these parent ions that are flying at the same speed. The parent ions, and the daughter ions created from the decomposition of the parent ions, are given a further acceleration of about 20 kilovolts in a post-acceleration unit 12, and their masses are analyzed by reflection in an ion reflector 14. A further ion selector 13 suppresses the parent ions and their daughter ions formed after post-acceleration, so that their further decomposition products, particularly those formed in the reflector, do not create a continuous background signal.
Figure 2:
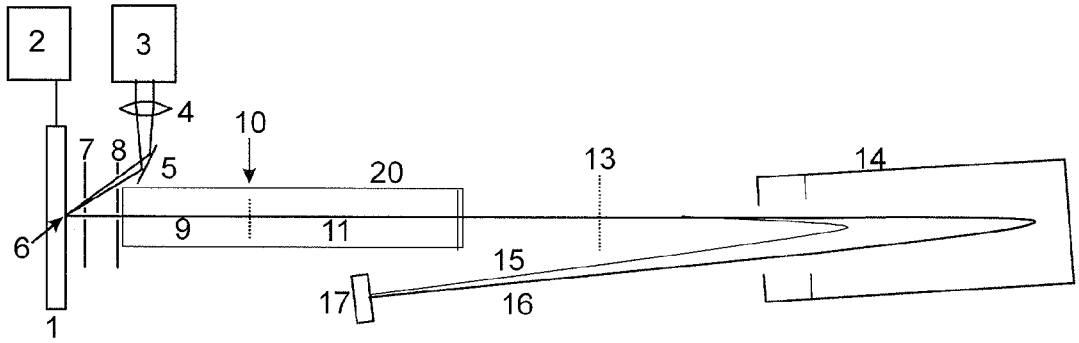
Figure 2 (prior art)
FIG. 2 illustrates a different embodiment of the prior art, in which the ions are generated at a high potential of the sample carrier plate 1 of around 26 kV, and are accelerated by the acceleration diaphragms 7 and 8 with only 6 kV into the tube 20. The parent ion selector 10 is mounted in the tube 20, which is at a potential of about 20 kV. The selected parent ions, and their daughter ions, are post-accelerated at the end of the tube 20. With this arrangement, the post-acceleration voltage does not need to be switched.

The MALDI time-of-flight mass spectrometer shown in FIG. 2 is most suitable as a basis for this invention because the high post-acceleration voltage for the daughter ions does not have to be switched, as is the case in the mass spectrometer according to FIG. 1 with a short post-acceleration unit 12. In the MALDI time-of-flight mass spectrometer of FIG. 2, the ions are generated at a high potential, and are held at a high potential in the tube 20 after their initial acceleration in the ion source by the diaphragms 7 and 8. The parent ions that are selected by the parent ion selector 10 and their daughter ions are then accelerated at the end of the tube 20 by the stationary potential gradient with respect to ground potential. The parent ions can then be masked out in the parent ion suppressor 13 so that the decomposition products generated after their second acceleration no longer disturb the daughter ion spectrum.

If several different species of parent ion from a single pulse of laser light are allowed through the parent ion selector 10 one after another, their individual daughter ion spectra can be measured successively at the ion detector 17, provided that the recording time for the individual daughter ion spectra is short enough. Because the parent ions still fly relatively slowly after their first acceleration, while the post-accelerated daughter ions, on the other hand, are very fast, it is possible to record the individual daughter ion spectra from several species of parent ion one after another without interference, as shown schematically in FIG. 4.

The design and mode of operation of the mass spectrometer can be particularly helpful for recording several daughter ion spectra in sequence. It is, for example, favorable if the flight time of the ions from the ion source to the post-acceleration unit is more than twice as long as the time of flight of the same ions from the post-acceleration unit through to the ion detector. This can be achieved by selecting a low initial acceleration voltage in the ion source, a long path from the ion source to the post-acceleration unit, a high post-acceleration voltage and a short path from the post-acceleration unit to the ion detector. It is even better if the time of flight in the first path up to the post-acceleration unit is at least three times longer.

If, however, the recording times for daughter ion spectra are longer than the time difference between two parent ions that are to be analyzed, the daughter ion spectra will overlap. In the daughter ion spectra, the signal width increases with increasing mass. This increase can be exploited, in the case of signal overlaps, to assign the signals to the individual daughter ion spectra. Slight overlaps can thus be quite easily separated again through data processing procedures. The distances of ion signals in isotope groups also change characteristically with mass in each mass spectrum, and this includes daughter ion spectra. These patterns of the isotope groups can also be used to identify the daughter ion spectra to which the individual ion signals belong, and to calculate daughter ion spectra that are free from overlaps. Calculations for separating overlapping mass spectra have already been described in U.S. Pat. No. 6,861,645.

FIG. 4 schematically illustrates the sequential recording of four daughter ion spectra Ti, T3, T6 and T9; here, an ideal situation with no overlaps is shown. The top part of FIG. 4 shows the signals 1 to 12 of the parent ions as a function of time, as they arrive at the parent ion selector. These signals can, for instance, originate from the unseparated digestion peptides of a protein that have been processed together to form a sample. This sequence of signals and their temporal relationships are known from a first spectrum acquisition, so a computer program can relatively easily determine which of the signals can be selected for acquiring the daughter ion spectra without any interference. In this case that is ion signals 1, 3, 6 and 9. Their daughter ion spectra T1, T3, T6 and T9 are measured, one after another, at the ion detector 17 without interference. The corresponding parent ions are masked out by switching the parent ion suppressor 13. The switching times required here can also be calculated easily.

Additional daughter ion spectra can then be measured in subsequent measuring cycles. For example, the daughter ion spectra from ion signals 2, 4, 7 and 11 can be measured in the next measuring cycle, and the daughter ion spectra from signals 5, 8 and 12 in the third cycle. Only the daughter ion spectrum of signal 10 then remains to be recorded in a fourth cycle of measurement. It is thus possible to record the twelve daughter ion spectra in four measuring cycles instead of twelve, so reducing the recording time and sample consumption by a factor of three. If slight overlaps can be accepted, these results can be improved yet further. It is then easily possible to measure the daughter ion spectra in only three measuring cycles, or even two measuring cycles if more pronounced overlaps are permitted. A "measuring cycle" refers here to the acquisition of daughter ion sum spectra in which a large number of pulses of laser light, possibly thousands, generate a corresponding number of plasma clouds.

If, therefore, a MALDI time-of-flight mass spectrometer with an embodiment according to FIG. 2 is available, it is only necessary to modify the software that controls the switching operations and the measuring process in order to execute a method according to an aspect of the invention.

This method can, of course, also be carried out using a MALDI time-of-flight mass spectrometer according to FIG. 1, but the post-acceleration unit 12 must be switched for each individual daughter ion spectrum. Since around 20 kV has to be switched, this irregular switching with high frequency demands very stably switchable voltage supplies, which even today represent an engineering challenge. The life time of the majority of power supply units used for this purpose nowadays is shortened by this mode of operation.

The MALDI time-of-flight mass spectrometer according to FIG. 1, however, permits operation with improved focusing of the daughter ions, as is described in U.S. Pat. No. 6,703,608. Because the delayed acceleration focuses the parent ions and their daughter ions on the parent ion selector 10, through which they, however, pass with a spread of energies, they are no longer time-focused when they reach the post-acceleration unit 12. The reflector 14 is not able to compensate for the absence of time focusing. It is, however, possible to temporarily raise the potential of the post-acceleration unit 12 slightly so as to give the slower ions that are lagging behind rather more post-acceleration energy, thus improving the time-focusing.

This kind of post-acceleration focusing can also be introduced through small design changes to MALDI time-of-flight mass spectrometers with the embodiment of FIG. 2. For this purpose, a short section at the end of the tube 20 has to be separated and given its own voltage supply. This voltage supply then has to be raised by a few tens of volts with an adjustable time gradient as the ions pass through. This gives somewhat more energy to the ions lagging behind, allowing them to catch up with the ions that are flying at the front. It should be remembered that, as a result of this method, the ion signals of the isotope groups are slightly compressed if the more or less complete isotope groups of the parent ions are to be selected in the parent ion selector.

Figure 3:
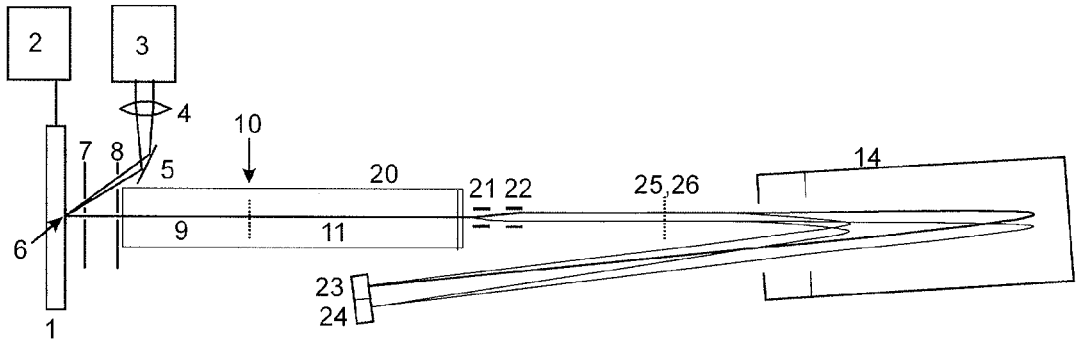
FIG. 3 illustrates an embodiment according to an aspect of the invention in which two series of daughter ions originating from two different species of parent ion are moved from their axis of flight by a pair of deflection capacitors 21 and 22 after their post-acceleration at the end of the tube 20, and are thereby diverted to two different ion detectors 23 and 24 for recording two different daughter ion spectra.

If more daughter ion spectra are to be measured quasi-synchronously than is possible in sequences, it is also possible for the beam of selected parent ions to be diverted spatially in such a way that the daughter ions from the various parent ion species hit different ion detectors, where they are measured. FIG. 3 shows a MALDI time-of-flight mass spectrometer of this type. The two deflection capacitors 21 and 22 permit the two ion beams from two different series of daughter ions to be laterally displaced far enough for them to hit two ion detectors 23 and 24, where they may be measured as separate daughter ion spectra. As a result of the double deflection applied to each, the ion beams come from two different, virtual starting locations, whose images are projected by focusing the reflector onto two different image locations.

If the reflector 14 operates with different focusing conditions, particularly in the case of reflectors with grids, it is also possible to divert the ion beams onto different ion detectors using a single deflection in just one deflection capacitor.

The arrangement illustrated in FIG. 3, where there are only two detectors 23 and 24, is only an example. Through a further deflection, perpendicular to the deflection provided by the deflection capacitors 21 and 22, it is easy to create a division into four ion beams that hit four ion detectors, thereby permitting four daughter ion spectra to be measured synchronously. If the individual ion beams are sharply focused onto small detector surfaces, it is possible to create for example a division into nine ion beams with nine detectors.

The ion detectors used are usually secondary electron amplifiers, implemented as multi-channel plates. The ion detectors may each include individual multi-channel plates, but it is also possible to simply mount four or nine separate electron receptors behind a single multi-channel plate. Good capacitive coupling is important here, so that each of the electron beams can be transmitted to its own amplifier without overshooting.

Even with two ion detectors and an additional temporal separation of the measurement of the daughter ion spectra, it is easy to measure something like six to ten daughter ion spectra quasi-synchronously; with four ion detectors, about twelve to twenty daughter ion spectra are possible. This radically shortens the time required to record daughter ion spectra. But the more efficient use of the sample is even more important. In the past, the usual rule of thumb was that from a well-concentrated sample prepared on a thin layer of α-cyano-4-hydroxycinnamic acid (CHCA) as matrix material, somewhere between five and fifteen daughter ion spectra may be measured before the sample was used up. A method according to an aspect of the invention now increases this number at least several times. For analyte substances of lower concentration, longer recording times and a higher consumption of samples had to be expected, and often it was simply not possible to obtain daughter ion spectra from such analyte substances of low concentration, as the sample was already used up by recording other daughter ion spectra. This invention makes it possible to obtain good daughter ion spectra even in these cases.

A short path covered by the ions from the acceleration diaphragm 8 to the parent ion selector 10 is unfavorable for a clean selection of the parent ions and for sequencing the measurements. But this distance may be lengthened, either by an appropriate basic design, or, for instance, by double reflection of the ions in two reflectors 18 and 19 between the acceleration diaphragm 8 and the parent ion selector 10, as illustrated in FIG. 5. This double reflection not only lengthens the path, but also improves the time-focusing of ions of the same mass, such that filtering of the parent ions is improved by better mass resolution.

For recording the molecular ions of the original mass spectrum (in other words, not the daughter ion spectra), all devices installed in the ion path, in particular anything with grids, are obstacles. These devices are therefore designed in such a way that they can be moved out of the ion path for recording normal molecular mass spectra. No loss of ions is then caused by passing through the grids. The units 12 for post-acceleration of the ions and 13 for suppression of the residual parent ions may also be moved out of the ion path. These units are only required for recording daughter ion spectra, and are only moved into the ion path for this purpose.

In principle, a single-mass species of ion may serve as parent ions for recording daughter ion spectra. Organic materials, however, contain mixtures of the isotopes of the participating elements; the mass spectrum therefore contains what are known as isotope groups, occupying several successive masses. If the parent ion selector only filters out those ions that have the main isotopes of their elements, that is $^{1}H$, $^{12}C$, $^{14}N$, $^{16}O$ or $^{32}S$, then only one signal for each species of daughter ion will appear in the daughter ion spectrum. It has, however, become usual to select the entire isotope group in the parent ion selector so that the various isotope groups are also seen in the daughter ion spectra. The visibility of the isotope groups in the daughter ion spectra increases confidence that they have been correctly identified. The invention is not an obstacle to such a procedure; as in the past, it is possible for the entire isotope group to be used for preparing the daughter ion spectra.

Although the present invention has been illustrated and described with respect to several preferred embodiments thereof, various changes, omissions and additions to the form and detail thereof, may be made therein, without departing from the spirit and scope of the invention.

What is claimed is:

1. A method for acquiring daughter ion spectra in a time-of-flight mass spectrometer, with an ion source for ionization of analyte molecules by matrix-assisted laser desorption, with a parent ion selector, a post-acceleration unit, and a first ion detector, the method comprising: directing a single desorbing pulse of laser light onto a sample to generate analyte ions, and accelerating the analyte ions into an ion beam in an original flight direction; fragmenting the analyte ions from parent ions into daughter ions by one of either (i) collisional induced dissociation between a first acceleration of the analyte ions at the ion source and the post-acceleration unit, or (ii) post-source decomposition of metastable ions; multiply switching the parent ion selector following the single desorbing pulse of laser light to create a sequence of switching time windows and to select a plurality of species of the parent ions with the associated daughter ions in a time sequence one after another such that the daughter ion spectra do not show substantial overlap, wherein switching includes allowing one selected species of the parent ions with the associated daughter ions to pass in a straight line per switching time window; post-accelerating the selected species of the parent ions with the associated daughter ions in the original flight direction with the post-acceleration unit; and measuring the daughter ion spectra from the selected species of the parent ions separately in the ion detector by temporal sequencing the measurements.

2. The method of claim 1, wherein in addition to the temporal sequencing, two series of daughter ions originating from two different selected species of the parent ions are moved from their axis of flight after the post-acceleration unit, and are thereby diverted to the first ion detector and a further ion detector, located proximate to the first ion detector, for recording two different daughter ion spectra.

3. The method of claim 1, wherein the species of the parent ions whose daughter ion spectra are to be measured sequentially are selected so that no substantial overlapping occurs during measurement of the daughter ion spectra.

4. The method of claim 1, wherein overlapping daughter ion spectra are separated by calculation using data processing procedures, and the widths of the ion signals or the patterns of isotope groups or both are employed to assign the ion signals to the daughter ion spectra they belong to.

5. The method of claim 1, wherein the switching comprises:

permitting each selected species of the parent ions with the associated daughter ions to pass straight through the parent ion selector during a switching time window; and otherwise filtering out non-selected species of the parent ions with the associated daughter ions.

6. A time-of-flight mass spectrometer for recording daughter ion spectra, comprising an ion source for ionization of analyte molecules by matrix-assisted laser desorption, a parent ion selector, a post-acceleration unit and a multitude of ion detectors, and a reflector substantially reversing a flight direction to incident ions, and further comprising deflection capacitors positioned after the post-acceleration unit and before the reflector to divert the ion beam onto one of the ion detectors.

7. The time-of-flight mass spectrometer of claim 6, further comprising deflection capacitors and reflectors between ion source and parent ion selector.

8. The time-of-flight mass spectrometer of claim 6, further comprising movement units for moving the parent ion selectors and post-acceleration units out of the path of the ion beam.

9. The time-of-flight mass spectrometer of claim 6, further comprising a voltage supply to raise the voltage in at least part of the post-acceleration unit during the passage of the ions so that a somewhat greater acceleration is imparted to ions that pass through at a later stage.

10. A method for acquiring daughter ion spectra in a time-of-flight mass spectrometer that includes an ion source for ionization of analyte molecules by matrix-assisted laser desorption, a parent ion selector, a post-acceleration unit, and a plurality of ion detectors, the method comprising:

directing a single desorbing pulse of laser light onto a sample to generate analyte ions, and accelerating the analyte ions into an ion beam in a first direction;

fragmenting the analyte ions from parent ions into daughter ions;

multiply switching the parent ion selector following the single desorbing pulse of laser light to create a sequence of switching time windows and to select a plurality of species of the parent ions with the associated daughter ions in a time sequence one after another such that the daughter ion spectra do not show substantial overlay wherein switching includes allowing one selected species of the parent ions with the associated ions to pass in a straight line per switching time window;

post-accelerating the selected species of the parent ions with the associated daughter ions in the first direction with the post-acceleration unit; and measuring the daughter ion spectra from the selected species of the parent ions with the ion detectors by spatially diverting the selected species of the parent ions downstream of the post-acceleration unit.

11. The method of claim 10, wherein the switching comprises:

permitting each selected species of the parent ions with the associated daughter ions to pass straight through the parent ion selector during a switching time window; and otherwise filtering out non-selected species of the parent ions with the associated daughter ions.

12. The method of claim 10, wherein the detectors are located side-by-side in a plane.

13. The method of claim 10, wherein the ion detectors are spatially separated segments of a single ion detector, wherein each segment measures a separate ion current.

14. The method of claim 10, wherein the ion detectors comprise one of two detectors, four detectors or nine detectors.

* * * * *